US005173360A

United States Patent [19]

Hiroe et al.

[11] Patent Number: 5,173,360

[45] Date of Patent: Dec. 22, 1992

[54] FABRIC FOR INKED RIBBON AND ITS MANUFACTURING METHOD

[75] Inventors: Nobutake Hiroe; Toshiaki Kadota; Tsuyoshi Hatakeda, all of Otsu, Japan

[73] Assignee: Toray Industries, Inc., Tokyo, Japan

[21] Appl. No.: 768,326

[22] PCT Filed: Mar. 27, 1991

[86] PCT No.: PCT/JP91/00403

§ 371 Date: Nov. 26, 1991

§ 102(e) Date: Nov. 26, 1991

[87] PCT Pub. No.: WO91/14580

PCT Pub. Date: Oct. 3, 1991

[30] Foreign Application Priority Data

Mar. 29, 1990 [JP] Japan ..... 2-83987

[51] Int. Cl.[5] ..... D03D 3/00

[52] U.S. Cl. ..... 428/229; 28/104; 400/241.3; 428/225; 428/257; 428/299

[58] Field of Search ..... 428/225, 226, 227, 229, 428/257, 299; 28/104, 167, 178, 210, 271; 400/241, 241.3

[56] References Cited

FOREIGN PATENT DOCUMENTS

| | | |
|---|---|---|
| 164177 | 9/1984 | Japan . |
| 61-24487 | 2/1986 | Japan . |
| 63-47186 | 2/1988 | Japan . |
| 3-11912 | 2/1991 | Japan . |

OTHER PUBLICATIONS

"Technological Innovation on Raw Fabric for Computer Ribbon Making", Asahi Chemical Industries Co., Ltd. Senken Newspaper, Mar. 19, 1988.

*Primary Examiner*—James J. Bell

*Attorney, Agent, or Firm*—Armstrong & Kubovcik

[57] ABSTRACT

This invention relates to a fabric for inked ribbon characterized in that it is a fabric using multifilaments of a twist of 30 T/m or less for the warp and has the fiber orientation in said warp disturbed through high pressure liquid treatment and to its manufacturing method.

The inked ribbon according to the present invention is applicable to the impact type serial dot printer, line printer and other printers and has very little hot spot produced and is distinguished in the ink absorption notwithstanding a very low twist of 30 T/m or less for the warp of the fabric.

11 Claims, 1 Drawing Sheet

FABRIC FOR INKED RIBBON AND ITS MANUFACTURING METHOD

SCOPE OF TECHNOLOGY

This invention relates to a method of manufacturing a fabric for the inked ribbon used in the printers such as impact type serial dot and line printers.

BACKGROUND ART

For the inked ribbon used in the impact type printers, the conventional spool type is decreasing, and the cassette type having the inked ribbon in the form of a long tape folded and housed in a cassette has become the main. But, the inked ribbon of the cassette type had a shortcoming to produce print spots, or hot spots as generally called, at the folded parts of the ribbon. For the fabric of the inked ribbon, a cloth composed of warps having a twist of 100 T/m or more and wefts of a twist of 0 to 300 T/m has been used. That is, to reduce the processing cost, the so-called non-twisting is being realized with the twisting process omitted for the wefts and the original twist of 30 T/m or less of the material yarn utilized for weaving. But, here, if such non-twisting is applied to the warps, the hot spots are generally produced, and so the inked ribbon is applicable only to limited uses such as spool type having hot spots scarcely produced.

On the other hand, in Patent Publication No. SHO 61-24487, it is described to disturb the fiber orientation of the cloth for inked ribbon with a high pressure water stream in order to dissolve the reel marks and improve the absorption of ink, but nothing is described of the method of dissolving the hot spots with the twist of the warp reduced.

DISCLOSURE OF THE INVENTION

In order to resolve the foregoing problem., the fabric for inked ribbon of the present invention has the following composition.

The fabric for inked ribbon according to the present invention is composed of a cloth having multifilaments of a twist of 30 T/m or less used for the warp, and it is characterized in that the fiber orientation in said multifilament is disturbed through high pressure liquid treatment.

Also, the method of manufacturing the fabric for inked ribbon according to the present invention is characterized by treating a cloth composed of warps of multifilaments of a twist of 30 T/m or less with a flow of high pressure liquid.

BEST EMBODIMENT OF THE INVENTION

Figure 1:
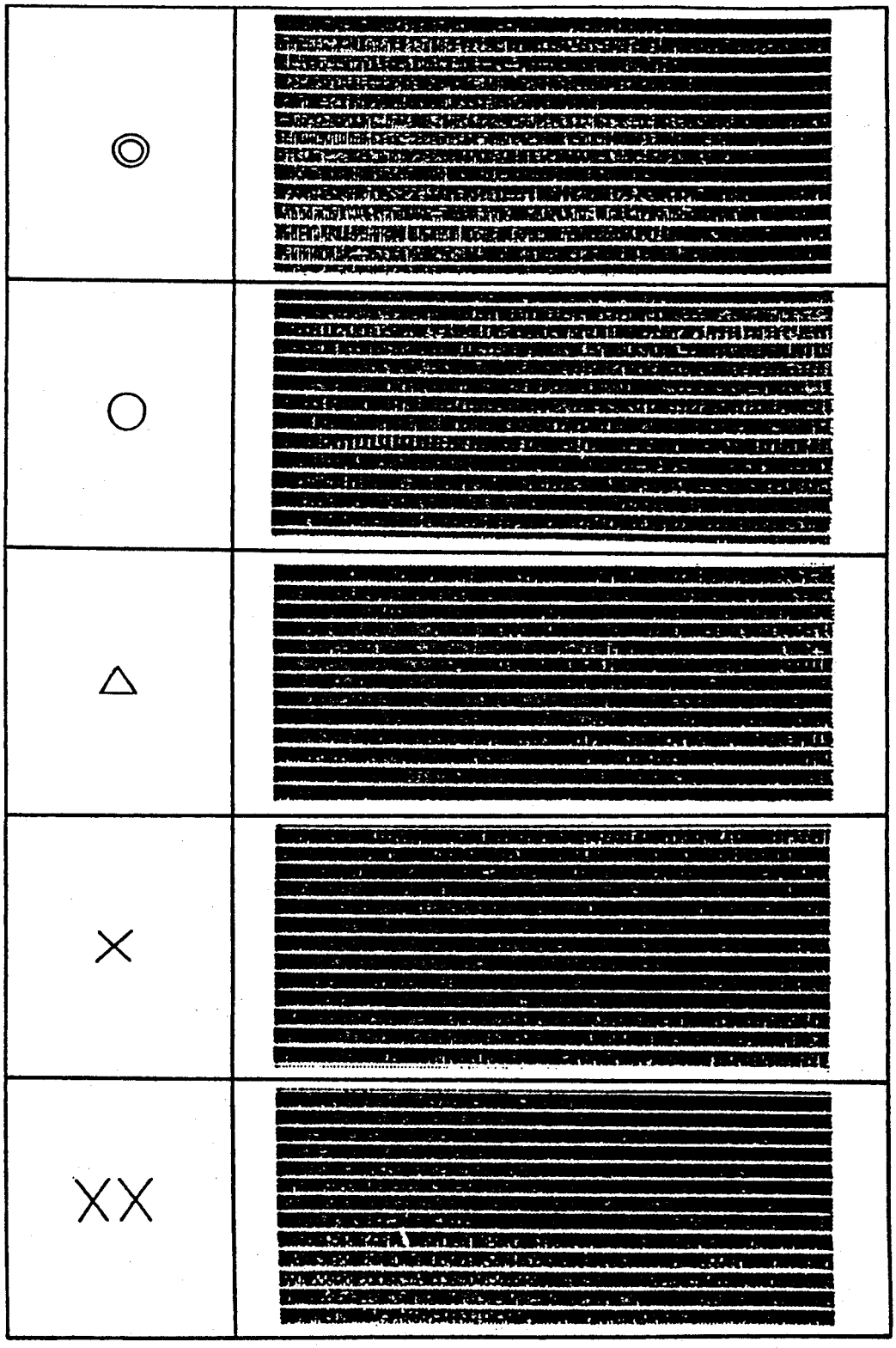
FIG. 1 shows the standard for evaluation of hot spots. That is the conditions of hot spots of various ranks of ribbons in solid printing.

According to the present invention, there is provided a fabric for inked ribbon scarcely producing hot spots by treating a cloth composed of multifilaments of a low twist of warps with a high pressure liquid. The fabric for inked ribbon of the present invention has the orientation of fibers in the filaments disturbed by the high pressure liquid treatment and thus has the voids in the fabric increased, and so it is distinguished in absorption of ink. Against the warps having a high twist given by additional twisting, the effect of improving the hot spots is readily obtainable, and the ink absorption is increased.

When subjected to the high pressure liquid treatment, the fabric shrinks more or less, and here by taking such shrinkage into account and weaving to a rather low fiber density, it is possible to provide a product of a desired fiber density and thickness.

As the material for the multifilament under the present invention, there may be listed the polyamide fiber, polyester fiber, polyacryl fiber and polyvinyl fiber. But, form the durability of the fabric, the polyamide fiber and polyester fiber are preferable, and nylon 66 and nylon 6 are particularly preferable.

The fabric constituting the inked ribbon is composed of a cloth having the foregoing fiber used for the warp as well as weft. The total denier of these yarns is preferably 20 to 100D or, more preferably, 40 to 70D, and the single yarn denier of the fiber constituting the yarn is preferably 1 d to 3d.

The textile density of the fabric is preferably 150 to 20 yarns/in. for the warp and 100 to 140 yarns/in. for the weft but is not limited thereto.

For the texture of the fabric, plain weave, derivative plain weave, twill and saten are preferably used but are not limited thereto.

In general, more hot spots are produced with lower twist of warp, greater warp density and greater yarn denier, that is, greater cover factor. The inventors found that such defect would be completely reversed by applying the high pressure liquid treatment and that non-twisting would be an important factor for improving the performance of the inked ribbon and thus came to the present invention.

The inventors examined the contribution of the warp and found that the warp would contribute to increasing the ink absorption but not so much as the weft for improvement of the hot spots.

The high pressure liquid treatment under the present invention refers to a method of spouting a liquid through a small hole under a high pressure to have it hit the fabric.

For such liquid, water, water vapor and air may be used, but water is particularly preferable from the cost, efficiency and safety. The liquid may contain an additive such as solid particles, an organic solvent or a surface active agent.

When water is used for the liquid for treatment, it is spouted under a high pressure of 5 to 200 kg/cm$^2$ or, more preferably, 10 to 100 kg/cm$^2$ through a line of small holes into a line of columnar streams to hit the fabric. When the water pressure is too low, a satisfactory effect of improving the hot spots is not obtainable, and when it is too high, the yarn orientation is excessively disturbed.

The diameter of the nozzle spouting water is preferably 0.1 to 0.4 mm or, more preferably, 0.2 to 0.35 mm.

The fabric treatment speed is preferably 5 to 100 m/min or, more preferably, 20 to 80 m/min.

The high pressure liquid treatment may be made in any of the scouring, drying and heat setting processes of the fabric but is efficiently made after scouring.

The fabric thus obtained has hot spots scarcely produced, equally to, or much more than, the conventional fabric composed of yarns of a twist of about 100 to 300 T/m through additional twisting and is thus distinguished as a fabric for inked ribbon.

EXAMPLES

The present invention will now be described in detail with reference to examples. The evaluation methods used under the invention are as follows.

Hot Spots

An inked ribbon (10 m long) prepared as above is set in a cassette for 9-pin dot printer (product of Tokyo Denki, model M-1550), and the cassette is set on the printer for solid printing, and any hot spots are observed with naked eye. The standard of evaluation is shown in FIG. 1, viz.

◎: No spot produced
○: Little spot produced
Δ: Dim spot produced
X: Dark spot produced
XX: Very dark spot produced

Ink Absorption

The fabric to be tested is melt cut into a size of 10 cm×10 cm to form a test specimen, then its weight (A) is measured. The test specimen is soaked in an oil ink, and defoaming by vacuuming, the ink is well permeated into the test specimen.

Then, removing the ink on the surface, the test specimen is held between filter papers to remove excessive ink through a mangle. Then, changing the filter papers, the test specimen is allowed to pass through the mangle twice to completely remove the excessive ink, and the weight (B) of the ink containing ribbon is measured.

The ink absorption is calculated by the formula $$IK=(B-A)\times 100$$

Examples 1 to 5, and References 1 and 2

Two kinds of yarns were prepared: a 40 denier/34 filament yarn of an original twist of 13 T/m, ahd a yarn having an additional twist of 273 T/m made to the first yarn to a total twist of 283 T/m together with the original twist of 13 T/m. Using these yarns, plain fabrics were woven in a water jet room, and they were scoured and dried according to the conventional method. Thereafter, Examples 1 through 5 had the high pressure water jet treatments shown in Table 1 rendered and, after drying, finish setting made. References 1 and 2 were directly subjected to finish setting without high pressure water flow treatment.

These fabrics were melt cut to a width of 13 mm to give a fabric for ink ribbon respectively which is then prepared into an inked ribbon for dot printer with an oil ink applied for 24% of the weight of the fabric.

Of these inked ribbons, the results of measurement of the hot spot and ink absorption are shown in Table 1.

As seen from Table 1, the inked ribbons of Examples 1 through 5 had the hot spot greatly improved and were good in ink absorption, provided Example 5 had the texture slightly deviated, as compared with the others, probably on account of the higher water pressure.

Reference 1 is of the same fabric design to the inked ribbons generally used for the 9-pin dot printer, but the hot spot is of Δ level.

Reference 2 is worse than Reference 1 in the level of hot spot.

Examples 6 to 10, and References 3 and 4

Using the similar warps and wefts to those of Examples 1 through 5 and References 1 and 2, plain fabrics were prepared in a water jet room, and they were scoured and dried according to the conventional method. Thereafter, Examples 6 through 10 had the high pressure water jet treatments shown in Table 2 and, after drying, finish setting given respectively.

References 3 and 4 were directly subjected to finish setting without high pressure water jet treatment.

These fabrics were melt cut into a width of 13 mm to give a fabric for inked ribbon, and with an oil ink applied for 22% of the weight of the fabric, inked ribbons for dot printer were provided. Of these inked ribbons, the hot spot and ink absorption were tested.

As seen from Table 2, the inked ribbons of Examples 6 through 10 had the hot spot greatly improved and were good in ink absorption, provided Examples 9 and 10 had the texture deviation produced rather greatly probably on account the greater water jet pressure.

Reference 3 is of the same fabric design to the inked ribbons generally used for the 24-pin dot printer, but the hot spot is of X level.

Reference 4 is a fabric for inked ribbon comprising warps of multifilament yarns of a twist of 30 T/m or less and has no high pressure water jet treatment rendered. It will be seen that the level of the hot spot is worse than that of Reference 3.

TABLE 1

| Example or Reference No. | | Examples | | | | | References | |
|---|---|---|---|---|---|---|---|---|
| | | 1 | 2 | 3 | 4 | 5 | 1 | 2 |
| Twist | Warp | 13 | 13 | 13 | 13 | 13 | 283 | 12 |
| | Weft | 13 | 13 | 13 | 13 | 13 | 13 | 13 |
| Textile density | Warp | 170 | 170 | 171 | 172 | 172 | 170 | 171 |
| | Weft | 114 | 115 | 115 | 115 | 117 | 114 | 115 |
| Water jet pressure | | 10 | 20 | 40 | 60 | 100 | — | — |
| Hot spot | | ○ | ○ | ◎ | ◎ | ◎ | Δ | × |
| Ink absorption | | 14.1 | 15.3 | 16.4 | 17.6 | 18.9 | 12.6 | 12.4 |
| Texture deviation | | ○ | ○ | ○ | Δ-○ | Δ | ○ | ○ |

TABLE 2

| Example or Reference No. | | Examples | | | | | References | |
|---|---|---|---|---|---|---|---|---|
| | | 6 | 7 | 8 | 9 | 10 | 3 | 4 |
| Twist | Warp | 13 | 13 | 13 | 13 | 13 | 283 | 13 |
| | Weft | 13 | 13 | 13 | 13 | 13 | 13 | 13 |
| Textile density | Warp | 208 | 208 | 209 | 210 | 212 | 209 | 208 |
| | Weft | 123 | 124 | 124 | 124 | 125 | 124 | 125 |
| Water jet pressure | | 50 | 70 | 90 | 110 | 150 | — | — |
| Hot spot | | ○ | ◎ | ◎ | ◎ | ◎ | × | ×× |
| Ink absorption | | 17.1 | 18.3 | 19.5 | 20.3 | 21.3 | 14.5 | 14.4 |

TABLE 2-continued

| Example or Reference No. | Examples 6 | 7 | 8 | 9 | 10 | References 3 | 4 |
|---|---|---|---|---|---|---|---|
| Texture deviation | | | | Δ | Δ | | |

Industrial Applicability

The inked ribbon comprised of the fabric of the present invention is very suitable and advantageous for the printers using the cassette type ribbon which is the main of the form of the inked ribbon in recent years. It scarcely produces hot spots and is distinguished in ink absorption. Furthermore, it uses the warp of a very low twist of 30 T/m or less and is thus economically produced.

Claims:

1. A fabric for inked ribbon characterized by being a fabric having multifilaments of a twist of 30 T/m or less for the warp and having the fiber orientation in the disturbed by high pressure fluid treatment.

2. The fabric for inked ribbon as set forth in claim 1 wherein said multifilament is a nylon 66 multifilament.

3. The fabric for inked ribbon as set forth in claim 1 wherein the twist of the weft of the fabric is 30 T/m or less.

4. The fabric for inked ribbon as set forth in claim 1 wherein the fineness of the warp or weft is 40 to 70 denier.

5. The fabric for inked ribbon as set forth in claim 1 wherein the warp density is 150 to 220 yarns/in. and the weft density is 100 to 140 yarns/in.

6. A method of manufacturing a fabric for inked ribbon characterized by treating a fabric having the warp composed of multifilaments of a twist of 30 T/m or less with a high pressure liquid stream.

7. The method of manufacturing the fabric for inked ribbon as set forth in claim 6 wherein the high pressure fluid is a high pressure water jet.

8. The method of manufacturing the fabric for inked ribbon as set forth in claim 6 wherein the twist of the weft is 30 T/m or less.

9. The method of manufacturing the fabric for inked ribbon as set forth in claim 6 wherein the synthetic multifilament fiber is a nylon.

10. The method of manufacturing the fabric for inked ribbon as set forth in claim 6 wherein the pressure of the high pressure liquid is 10 to 100 kg/cm$^2$.

11. The method of manufacturing the fabric for inked ribbon as set forth in claim 6 wherein the high pressure fluid stream is a fluid stream spouted from a nozzle of a diameter of 0.2 to 0.35 mm.

* * * * *